US005445375A

United States Patent [19]

Sweeny

[11] Patent Number: 5,445,375

[45] Date of Patent: Aug. 29, 1995

[54] GOTCHA BALL TOY

[76] Inventor: John R. Sweeny, 4828 Berridge, Dallas, Tex. 75227

[21] Appl. No.: 201,334

[22] Filed: Feb. 24, 1994

Related U.S. Application Data

[63] Continuation of Ser. No. 996,063, Dec. 23, 1992, abandoned.

[51] Int. Cl.[6] ..... A63B 43/00

[52] U.S. Cl. ..... 273/58 E; 273/58 G

[58] Field of Search ..... 273/460, 58 R, 58 E, 273/58 G, 213, 432, 458, 138 R; 446/397, 409, 297, 404

[56] References Cited

U.S. PATENT DOCUMENTS

| | | | |
|---|---|---|---|
| 3,304,650 | 2/1967 | Glass et al. | 273/58 G |
| 4,595,200 | 6/1986 | Shishido | 273/58 G |
| 4,662,260 | 5/1987 | Rumsey | 273/58 G |
| 4,737,134 | 4/1988 | Rumsey | 273/58 G |
| 4,801,141 | 1/1989 | Rumsey | 273/85 G |
| 4,874,165 | 10/1990 | Steinberg et al. | 273/58 E |
| 4,900,020 | 2/1990 | Rehkemper et al. | 273/458 |
| 4,991,847 | 2/1991 | Rudell et al. | 273/138 R |
| 5,178,545 | 1/1993 | Thompson | 273/432 |
| 5,288,069 | 2/1994 | Matsumoto | 273/58 G |

FOREIGN PATENT DOCUMENTS

| | | | |
|---|---|---|---|
| 2213069 | 8/1989 | United Kingdom | 273/58 E |

OTHER PUBLICATIONS

"Whats New products/technology" Popular Science Sep. 12, 1987, p. 30.

*Primary Examiner*—Jessica J. Harrison

*Attorney, Agent, or Firm*—John E. Vandigriff

[57] ABSTRACT

The invention is to a ball toy and game method utilizing the ball device. The ball toy includes two hemispherical parts that may be separated to enclose an electronic timing device and a digitized voice module. The electronic timing device is actuated by pressing a button switch to initiate a randomly programmed timer. The randomly programmed timer will, at the end of the randomly programmed time interval actuated a voice module that will enunciate the word "gotcha", or any other programmed word.

15 Claims, 3 Drawing Sheets

GOTCHA BALL TOY

This application is a continuation of Ser. No. 07/996,063, filed Dec. 23, 1992, now abandoned.

FIELD OF THE INVENTION

The invention relates to toys and games, and more particularly to a ball toy having a randomly time activated switch, and a digital voice module.

BACKGROUND OF THE INVENTION

Various patents define ball shaped configurations. U.S. Pat. No. 4,991,847 uses a ball shaped configuration that has an internal compartment in which a water filled balloon is enclosed. A spring driven motor drives an abrasive wheel or disk having a abrasive coating thereon. The spring driven motor turns the wheel such that the abrasive will rub against the water filled balloon, rupturing the balloon and releasing the water.

In U.S. Pat. No. 4,872,854, a ball shaped device has the appearance of, for example, a base ball. An electronic device is in the ball shaped device such as a radio and/or clock.

U.S. Pat. No. 3,304,650, describes a toy bomb that is generally balled shaped with a "fuse" attached to the bomb body. A spring driven clock-type mechanism strikes a bell at user selectable time intervals.

SUMMARY OF THE INVENTION

The invention is to a ball device and game method utilizing the ball device. The ball device includes two hemispherical parts that may be separated to enclose an electronic timing device and a digitized voice module. The electronic timing device is actuated by pressing a button switch to initiate a randomly programmed timer. The randomly programmed timer will, at the end of the randomly programmed time interval actuated a voice module that will enunciate the word "gotcha", or any other programmed word.

In a game method utilizing the ball device, the ball device is handed or tossed between two or more persons. The person holding the ball device when the word "gotcha" is enunciated, may be required to perform a task, or be eliminated from the game.

The voice module may be programmed to enunciate other words including numbers. The number enunciated may be based on the randomly programmed time interval, a different number for each randomly selected time interval, thereby producing random numbers.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT OF THE INVENTION

Figure 1:
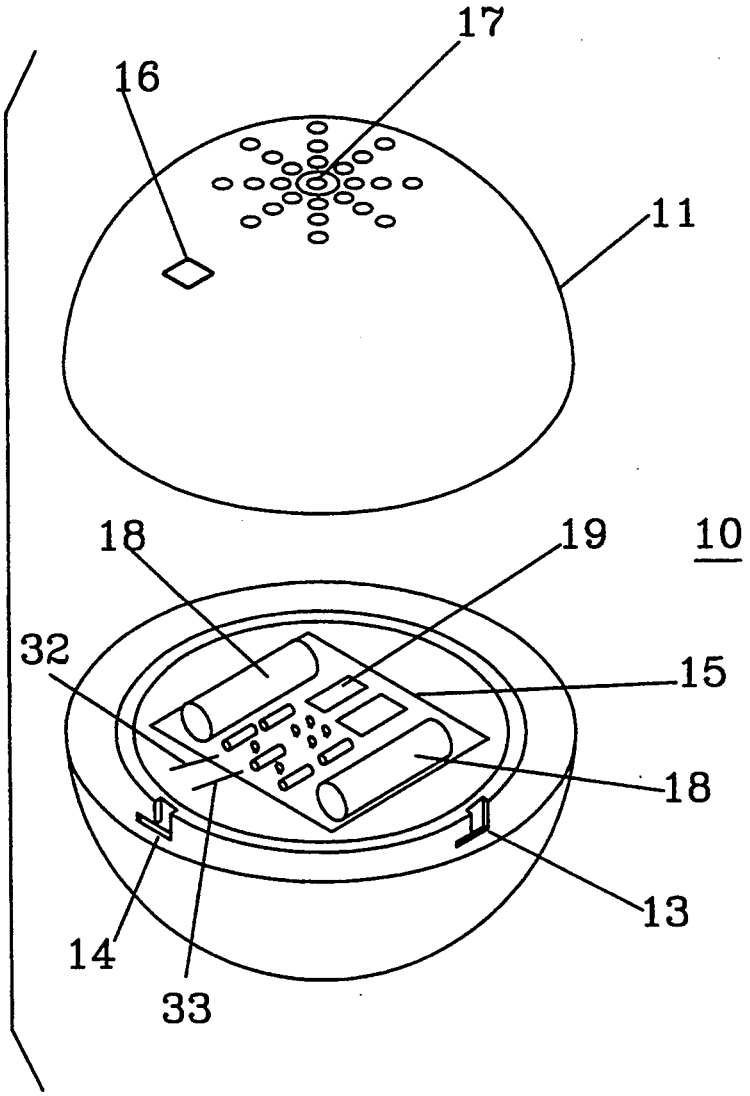
FIG. 1 illustrates an exploded view of the ball device of the present invention.

FIG. 1 is an exploded view of the present invention. Ball device 10 is made up of two hemispherical parts, top part 11 and bottom part 12.

Top part includes openings 17 through which a speaker device (not illustrated) provides the digitized voice output. Top 11 also has a switch opening 16 in the surface. A switch in opening 16 is use to initiate the timing cycle to produce the voice output.

Bottom part 13 has at least two twist lock openings 13 and 14. Mating parts on top 11 (not illustrated) are utilized to secure top 11 to bottom 12.

Also mounted in bottom 13 is an electronic module 15 that includes batteries 18 and components 19. Components 19 provide the circuitry to produce the digitized voice and the randomize timing intervals. Connecting wires 32 and 33 attach to switch 30 in top 11 (FIG. 3).

Figure 2:
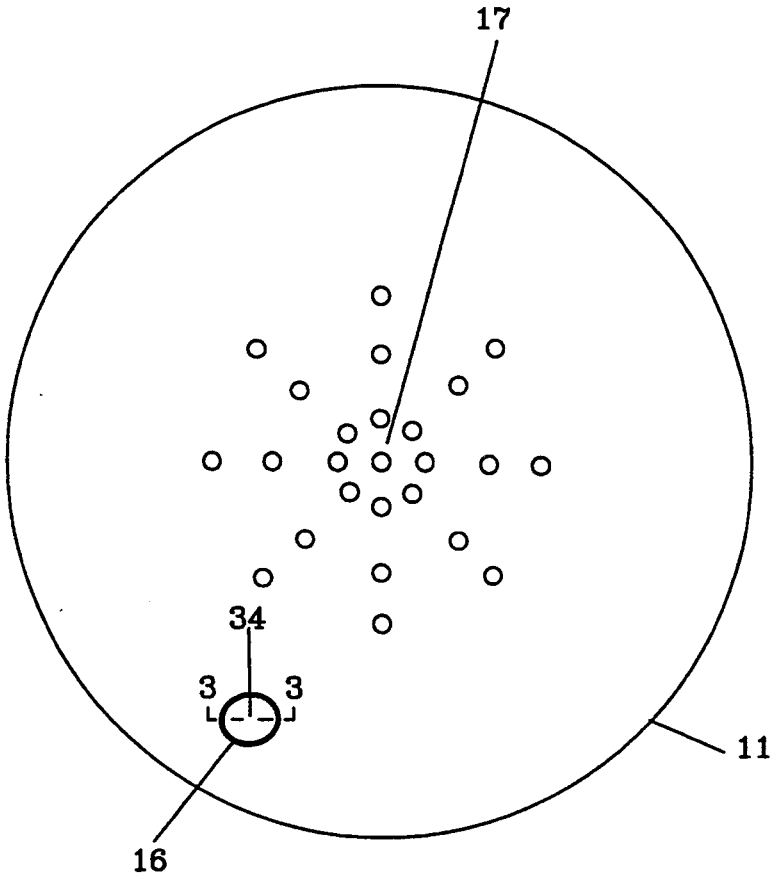
FIG. 2 is a top view of the ball device.

FIG. 2 is a top view of ball device top 11. Speaker openings 17 are shown in a symmetrical pattern. Any pattern may use to provide passage for sound to pass through the ball device wall.

Figure 3:
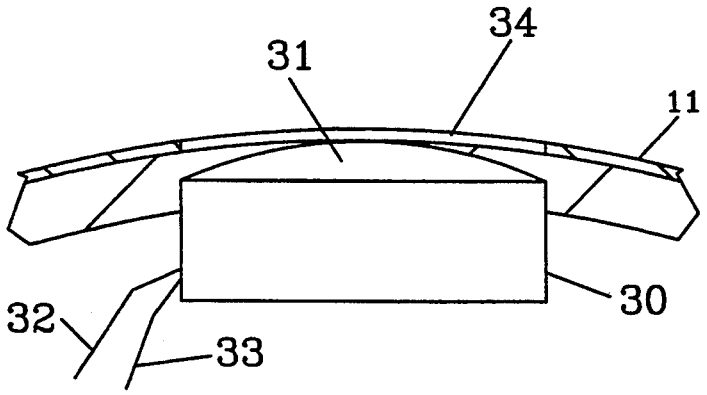
FIG. 3 is a cross-sectional view of the start button.

Switch open 16 is shown in FIG. 2, and a cross-sectional view through section 3—3 in FIG. 3. Ball top wall 11 has opening 16 through which switch top 31 extends. A flexible membrane 34 may cover opening 16 to protect switch 31 and to prevent dust from entering into the interior of ball device.

Switch 30 is attached to the circuitry on electronic module 150 by connecting wires 32 and 33.

Figure 4:
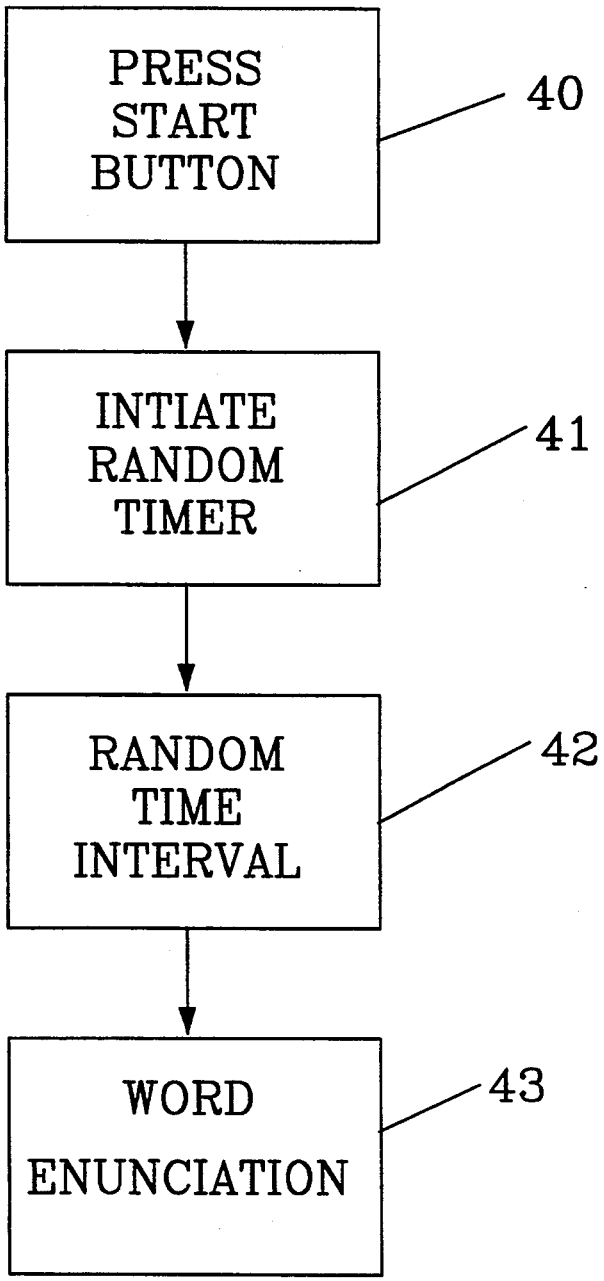
FIG. 4 is a block diagram of the operation of the ball device.

The basic operation of the ball device is illustrated in FIG. 4. In block 40, the start button (switch 30 FIG. 3) is pressed to initiate a randomly produce timing cycle (Block 41). The random timer (Block 42) starts a counting cycle. At the end of the timing cycle, a signal is sent to the word enunciator in block 43. If the ball device is programmed to enunciate a word, such as "gotcha", the word is enunciate on receipt of the signal received from the timer. If a number is to be enunciate, then the signal contains information, based upon the random timing cycle, to produce the corresponding number. After the word or number is enunciated, the electronic module 15 turns itself off, removing power from the module.

A game method utilizing the ball toy when programmed to enunciate the word "gotcha" includes the initial step of pressing the start switch, initiating a randomly determined timing cycle. Each person playing the game method is given a fixed number of points. Next the ball toy is tossed between two or more persons until the word "gotcha" is enunciated by the ball toy. The person holding the ball toy when "gotcha" is enunciated, has a fixed number of points subtracted from the initial fixed number of points. The game is continued for a fixed period of time or for a specific number of random intervals. The person having the most points remaining after the fixed period of time or specific number of random intervals, wins the game.

An alternative game method may he that the person holding the ball toy when the word "gotcha" is enunciate has to perform a task or perform in some manner.

A game method utilizing the ball toy when programmed to enunciate a number may be as follows. The start switch is pressed and at a randomly selected timing interval, a number is enunciated. The program numbers may be the same as the number found on one or more dice. In this instance, the ball toy may be utilized in any game that uses dice.

What is claimed:

1. A ball toy device, comprising:

a hollow spherical housing;

an electronic module inside said housing for producing an audio signal selected from a randomly selected number and the word "gotcha";

a randomly self-selective time interval timer for activating said audio signal independent of any external input;

a switch for initiating the randomly self-selective time interval; and a circuit in said electronic module for turning off power to said electronic module after the audio signal has been activated.

2. The ball toy according to claim 1, wherein said electronic module includes a digital voice module for generating at least one word for said audio signal.

3. The ball toy according to claim 1, wherein said audio signal is a digitally produce word.

4. The ball toy according to claim 1, wherein said hollow spherical housing has an outer shell, and said switch is mounted flush with the outer shell.

5. The ball toy according to claim 4, including a flexible membrane over said switch.

6. The ball toy according to claim 1, including an array of holes in said spherical housing, and a speaker mounted inside said housing adjacent said array of holes for emitting said audio signal.

7. The ball toy according to claim 1, wherein said spherical housing includes two hemispherical parts, the two parts held together by a twist-lock mechanism.

8. A ball toy device, comprising:

a hollow spherical housing;

an electronic module inside said housing for producing a digitally produced spoken word;

a randomly self-selective time interval timer for activating said spoken word independent of any external input, said spoken word includes randomly selected numbers;

a switch for initiating the randomly self-selective time interval; and a circuit in said electronic module for turning off power to said electronic module after the audio signal has been activated.

9. The ball toy according to claim 8, wherein said spoken word is the word "gotcha".

10. The ball toy according to claim 8, wherein said hollow spherical housing has an outer shell, and said switch is mounted flush with the outer shell.

11. The ball toy according to claim 10, including a flexible membrane over said switch.

12. The ball toy according to claim 8, including an array of holes in said spherical housing, and a speaker mounted inside said housing adjacent said array of holes for emitting said audio signal.

13. The ball toy according to claim 8, wherein said spherical housing includes two hemispherical parts, the two parts held together by a twist-lock mechanism.

14. A ball toy device, comprising:

a hollow spherical housing;

an electronic module inside said housing for producing digitally the spoken word selected from the word "gotcha" and a randomly selected number;

a randomly self-selective time interval timer for activating said spoken word independent of any external input; and a switch for initiating the randomly self-selective time interval; and a circuit in said electronic module for turning off power to said electronic module after the audio signal has been activated.

15. A method of playing a game with a ball toy including a voice module, a randomly self-selective time interval timer, and an activation switch, including the steps of:

initiating the randomly self-selective time interval timer by pressing the switch;

tossing the ball toy between persons until the randomly self-selective time interval ends, independent of any external input, resulting in an audible signal selected from the word "gotcha" and a randomly selected number produced by said voice module;

imposing a task upon the person possessing the ball toy dependent upon the randomly selected number.

* * * * *